US009194546B1

(12) United States Patent
Izradel

(10) Patent No.: US 9,194,546 B1
(45) Date of Patent: Nov. 24, 2015

(54) LED BENT PANEL LIGHT ASSEMBLY

(71) Applicant: Lazar Izradel, Tel Aviv (IL)

(72) Inventor: Lazar Izradel, Tel Aviv (IL)

(73) Assignee: Gamasonic USA Inc., Atlanta, GA (US)

( * ) Notice: Subject to any disclaimer, the term of this patent is extended or adjusted under 35 U.S.C. 154(b) by 0 days.

(21) Appl. No.: 14/450,302

(22) Filed: Aug. 4, 2014

(51) Int. Cl.
*F21K 99/00* (2010.01)
*F21S 9/03* (2006.01)
*F21Y 103/02* (2006.01)

(52) U.S. Cl.
CPC . *F21K 9/52* (2013.01); *F21S 9/035* (2013.01); *F21Y 2103/022* (2013.01)

(58) Field of Classification Search
None
See application file for complete search history.

(56) References Cited

U.S. PATENT DOCUMENTS

| | | | | |
|---|---|---|---|---|
| 7,160,012 | B2 * | 1/2007 | Hilscher et al. | 362/555 |
| 8,761,565 | B1 * | 6/2014 | Coleman et al. | 385/146 |
| 2010/0002425 | A1 * | 1/2010 | Tsai et al. | 362/223 |
| 2011/0234076 | A1 * | 9/2011 | Simon et al. | 313/46 |
| 2011/0291560 | A1 * | 12/2011 | Wang et al. | 315/32 |
| 2011/0309735 | A1 * | 12/2011 | Parker et al. | 313/46 |
| 2012/0139403 | A1 * | 6/2012 | Johnston et al. | 313/46 |
| 2012/0169235 | A1 * | 7/2012 | Dassanayake et al. | 315/113 |
| 2013/0027939 | A1 * | 1/2013 | Hisayasu et al. | 362/249.02 |
| 2014/0092580 | A1 * | 4/2014 | McCollum et al. | 362/84 |

* cited by examiner

*Primary Examiner* — Britt D Hanley
(74) *Attorney, Agent, or Firm* — Dekel Patent Ltd.; David Klein

(57) ABSTRACT

A light assembly includes an optically-transmissive panel bent so as to span more than 180° about a central axis. The optically-transmissive panel has top and bottom edge surfaces. An array of LEDs is disposed adjacent at least one of the top and bottom edge surfaces. The optically-transmissive panel is operative to produce a uniform distribution of light received from the array of LEDs. Circuitry is arranged to electrically connect the array of LEDs with a power source.

9 Claims, 6 Drawing Sheets

LED BENT PANEL LIGHT ASSEMBLY

FIELD OF THE INVENTION

The present invention relates generally to lighting assemblies, and more particularly to an LED bent panel light assembly.

BACKGROUND OF THE INVENTION

For years, lighting systems, such as ceiling mounted lighting fixtures or luminaires, have made use of fluorescent lamps and/or incandescent lamps. In addition to the lamps, lighting systems typically include an assembly of components, such as ballasts and reflectors. Luminaires that incorporate fluorescent lamps are the most commonly used commercial light sources due to their relatively high efficiency, diffuse light distribution characteristics, and long operating life. Luminaires that incorporate light emitting diodes are emerging as an attractive alternative to fluorescent lamp luminaires, providing marked improvements in efficiency and operating life. LED flat panel lighting fixtures are now replacing fluorescent lights, such as in drop ceilings.

SUMMARY OF THE INVENTION

The present invention seeks to provide an improved lighting assembly, such as a LED bent panel light assembly, as is described more in detail hereinbelow.

There is thus provided in accordance with an embodiment of the present invention a light assembly including an optically-transmissive panel bent so as to span more than 180° about a central axis, the optically-transmissive panel having top and bottom edge surfaces, an array of LEDs disposed adjacent at least one of the top and bottom edge surfaces, the optically-transmissive panel operative to produce a uniform distribution of light received from the array of LEDs, and circuitry arranged to electrically connect the array of LEDs with a power source. The optically-transmissive panel may, for example, span 360° about the central axis. In one example, the optically-transmissive panel continuously curves about the central axis. In another example, the optically-transmissive panel is conically shaped and the array of LEDs is ring-shaped.

In accordance with an embodiment of the present invention a light modification layer is adjacent the optically-transmissive panel operative to modify light impinging thereon. For example, the light modification layer includes a reflective layer inwards of the optically-transmissive panel. In another example, a transparent glossy layer is between the light modification layer and the optically-transmissive panel.

The optically-transmissive panel may have different shapes, and for example, may include at least one flat portion.

A solar energy collecting portion may be mounted on the light assembly. The solar energy collecting portion may include at least one solar photovoltaic panel for collecting and converting incident solar energy to electricity to power the array of LEDs. One or more batteries may be provided that store electricity from the solar energy collecting portion, the batteries being electrically connected to the array of LEDs.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
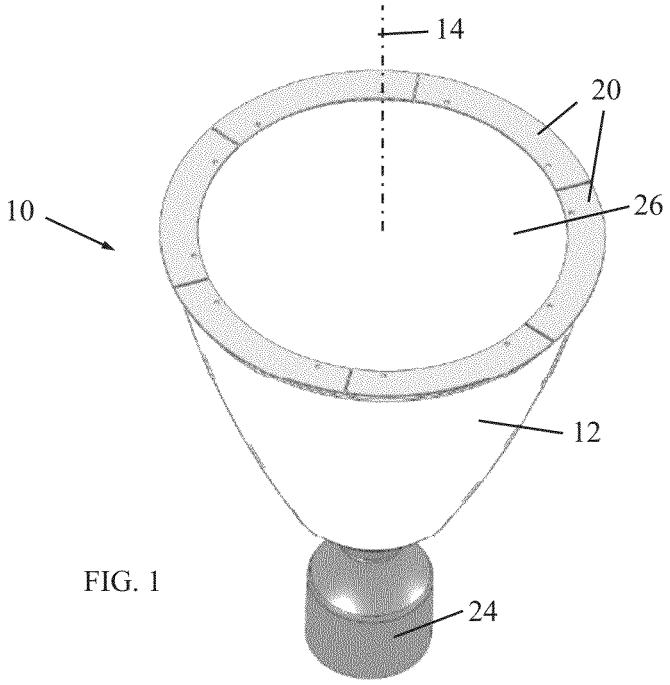
FIGS. 1 and 2 are simplified perspective illustrations of an LED bent panel light assembly, constructed and operative in accordance with a non-limiting embodiment of the present invention.
Figure 2:
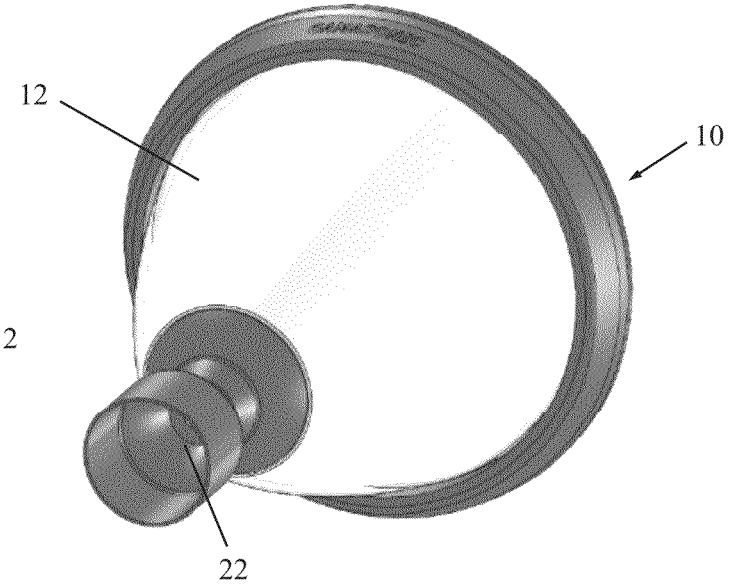
Figure 3:
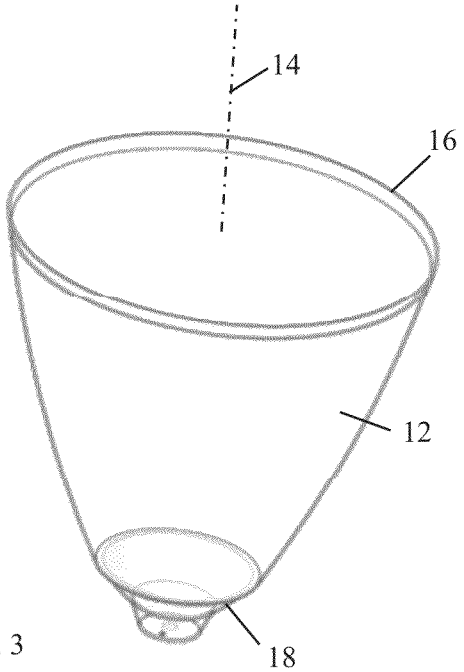
FIG. 3 is a simplified perspective illustration of an optically-transmissive panel of the light assembly, the panel being bent so as to span more than 180° about a central axis, in accordance with a non-limiting embodiment of the present invention.

Reference is now made to FIGS. 1-3, which illustrate a light assembly 10, constructed and operative in accordance with a non-limiting embodiment of the present invention.

The light assembly 10 includes an optically-transmissive panel 12 bent so as to span more than 180° about a central axis 14. The term "bent" encompasses any type of forming technique, such as but not limited to, bending, molding, folding, curving and others. Panel 12 is made of an optically-transmissive material, such as but not limited to, polycarbonate and the like. For example, without limitation, panel 12 may be made of a white milky semi-transparent material (e.g., polycarbonate or acrylate) with roughened outer surface, having a thickness of 1.6 mm.

Figure 6A:
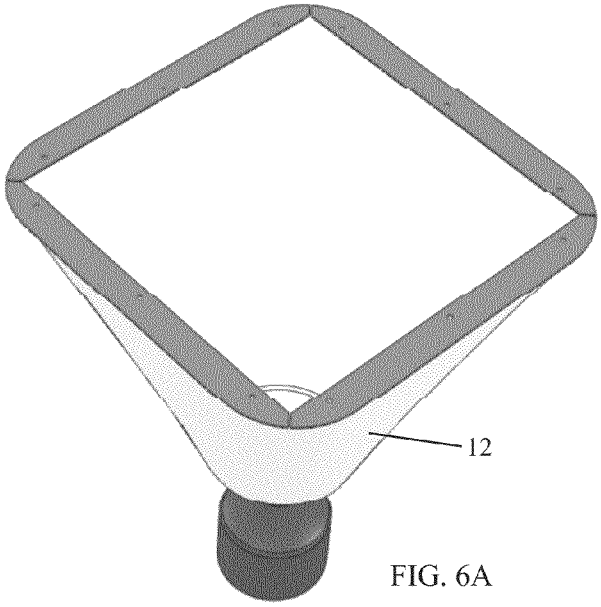
FIGS. 6A-6E are simplified illustrations of LED bent panel light assemblies, in accordance with other non-limiting embodiments of the present invention, wherein the LED bent panel is one piece, yet has one or more flat faces.
Figure 6B:
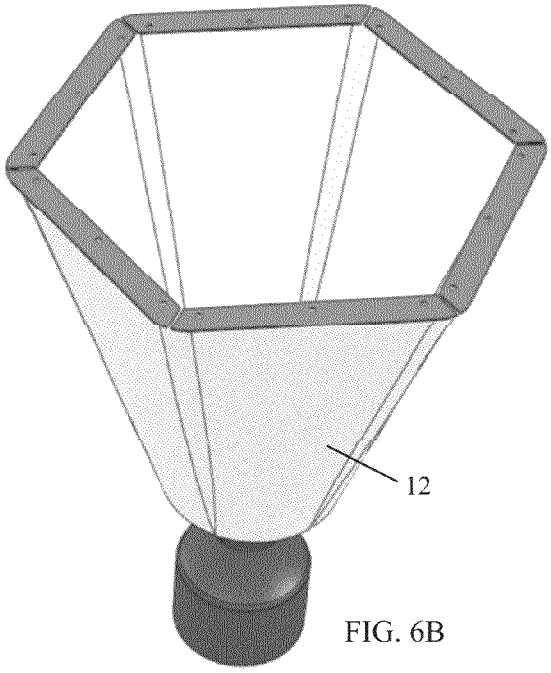
Figure 6C:
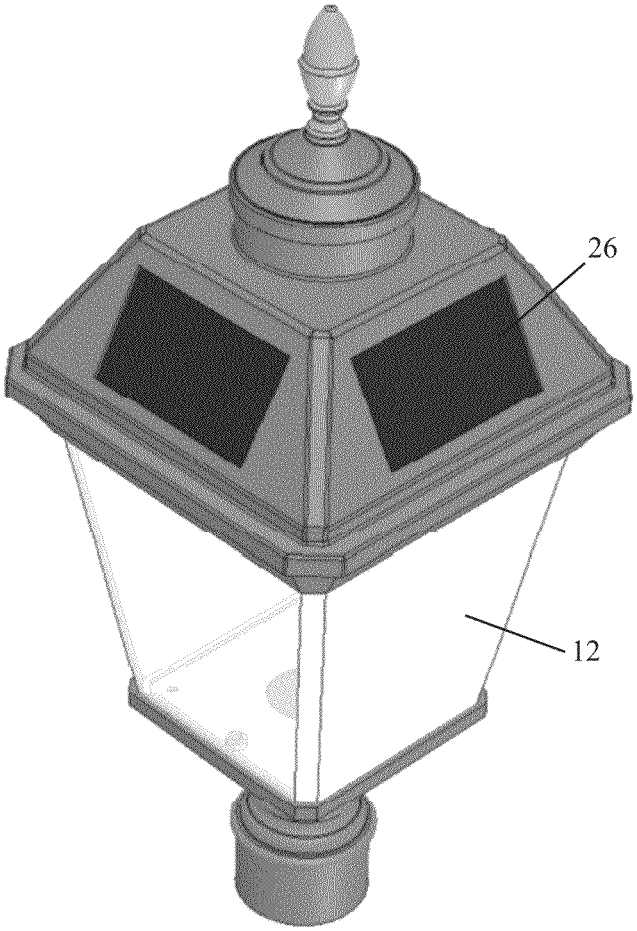

The optically-transmissive panel 12 may, for example, span 360° about the central axis 14. In the illustrated embodiment, panel 12 continuously curves about central axis 14 and is conically shaped. (FIGS. 6A-6C illustrate other exemplary shapes, wherein panel 12 has one or more flat sides, as described below.)

It is noted that the prior art only uses flat sheet LED panels. This would require mounting the flat panels in frames to get a prismatic or polyhedral shape. In contrast, the present invention uses a one-piece, bent panel 12, which provides advantages in terms of cost and assembly.

Figure 5:
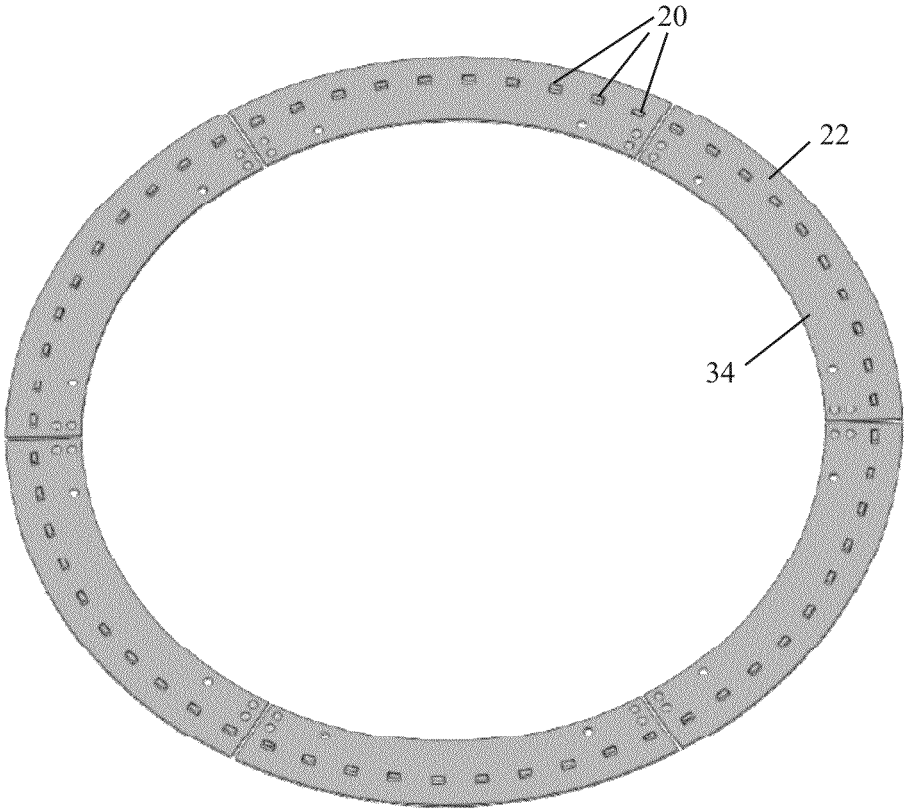
FIG. 5 is a simplified perspective illustration of an array of LEDs.

The optically-transmissive panel 12 has top and bottom edge surfaces 16 and 18 (FIG. 3), respectively. An array of LEDs 20 (FIGS. 1 and 5) is disposed adjacent at least one of the top and bottom edge surfaces 16 and 18. In the illustrated embodiment, the LEDs 20 are mounted on top of top edge 16 and are ring-shaped. The array of LEDs 20 may be all around the perimeter or may span a portion of the perimeter of the top and/or bottom edge surfaces (such as an arc of 90° or 180° for a round perimeter, or just one or a few sides for a polygonal perimeter). The optically-transmissive panel 12 produces a uniform distribution of light received from LEDs 20. Circuitry 22 (partially shown in FIG. 5 and partially in FIG. 2) electrically connects the array of LEDs 20 with a power source 24, such as one or more batteries 24.

The LEDs 20 may be of any amount, size, mcd rating, and color (e.g., white, red, green, blue, yellow or other non-white colors, or a RGB (red, green, blue) changing LED, or any combination thereof). "White" is defined as the color that has no or little hue, due to the reflection of all or almost all incident light. "White" in the specification and claims encompasses bright white, warm white, "dirty" white, off-white, gray-white, snow white, hard-boiled-egg white and other shades of white. The colors of the lights may be programmed to change at predefined or random intervals, providing different lighting effects.

A solar energy collecting portion 26 (FIG. 1) may be mounted on light assembly 10. Solar energy collecting portion 26 may include one or more solar photovoltaic panels for collecting and converting incident solar energy to electricity to power the array of LEDs 20. In the illustrated embodiment, without limitation, the solar photovoltaic panel 26 is a disc of 300 mm diameter. Batteries 24 store electricity from the solar energy collecting portion 26.

The LEDs 20 and batteries 24 may advantageously be low voltage, such as but not limited to, 3-4 V (e.g., batteries 24 may be lithium phosphate batteries). In this manner, the invention advantageously uses low power in a solar outdoor application, in contrast with prior art outdoor solar systems that use 12 V LEDs and higher voltage batteries with more complicated circuitry.

It is noted that in alternative embodiments, instead of solar power, the LEDs may be powered by AC or DC power from mains or other sources, with appropriate adaptors, inverters, rectifiers, converters, etc., as needed.

Figure 4:
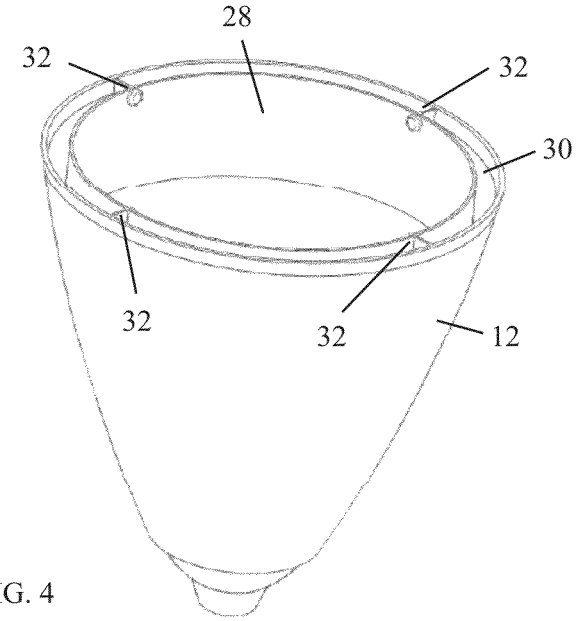
FIG. 4 is a simplified perspective illustration of light modifying layers inwards of the optically-transmissive panel, in accordance with a non-limiting embodiment of the present invention.

In accordance with an embodiment of the present invention a light modification layer 28 (FIG. 4) is adjacent optically-transmissive panel 12 and modifies light impinging thereon. For example, the light modification layer 28 includes a reflective layer inwards of the optically-transmissive panel 12. For example, layer 28 may be a white material (plastic, such as polycarbonate, or metal, such as aluminum) with a glossy, reflective outer surface, having a thickness of 3.0 mm. In another example (seen in FIG. 4), a transparent glossy layer 30 is between the light modification layer 28 and the optically-transmissive panel 12. For example, layer 30 may be a transparent glossy material (e.g., plastic), with a laser-formed pattern of points on its inside surface, having a thickness of 3.0 mm.

Accordingly, in order to create strong, homogeneous peripheral lighting, the LED bent panel light assembly may use three surfaces. An inner surface (light modification layer 28) can be made of a dense mesh or reflective surface to receive the light rays from the LEDs. A middle transparent surface (layer 30) increases the light intensity. An outside surface (optically-transmissive panel 12) can be made of translucent or milky material for uniform distribution of the light.

In the illustrated embodiment, without limitation, the layers 28 and 30 are connected to panel at four bayonet connection points 32. The array of LEDs 20 are mounted on a substrate 34 (FIG. 5), and this substrate 34 and the solar photovoltaic panel 26 are firmly mounted over (such as by snap connection) the bayonet connection points 32. The substrate 34 may be made of a heat conducting material (e.g., aluminum) to dissipate heat from the LEDs 20.

The layers 28 and 30 may be alternatively formed from films deposited on panel 28. The panel 12 may also include a brightness enhancement film disposed thereon, which collimates light to improve the overall light output from panel 12.

Figure 6D:
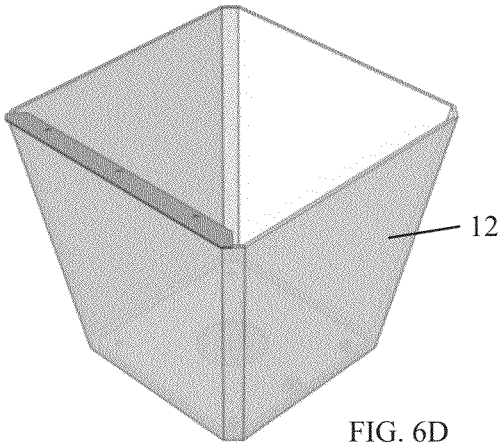
Figure 6E:
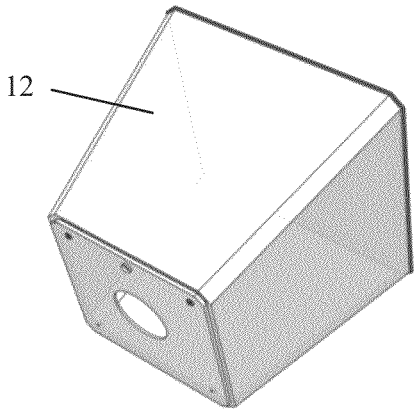

As mentioned above, FIGS. 6A-6C illustrate other exemplary shapes, wherein panel 12 has one or more flat sides. In FIG. 6A, panel 12 has a square or rectangular shape with sloping sides and round edges between the sides. In FIG. 6B, panel 12 has a hexagonal shape with sloping sides and prismatic edges between the sides. In FIG. 6C, panel 12 has a square or rectangular shape with sloping sides and prismatic edges between the sides. The solar energy collecting portion 26 has four solar collecting panels which are mounted on top of the light assembly. FIGS. 6D-6E illustrate the same panel of FIG. 6C without the solar energy collecting portion.

In general, it should be noted that the edges between adjacent flat sides may be, prismatic or curved or close to sharp with a very small radius of curvature, depending on the manufacturing technique to form the panel and its material. The invention is not limited to the number of sides, such as 3-10 or more, and may have shapes such as square, round, elliptic and many more.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A light assembly comprising:

an optically-transmissive panel bent so as to span more than 180° about a central axis, said optically-transmissive panel having top and bottom edge surfaces;

an array of LEDs disposed adjacent at least one of said top and bottom edge surfaces, said optically-transmissive panel operative to produce a uniform distribution of light received from said array of LEDs;

circuitry arranged to electrically connect said array of LEDs with a power source;

a light modification layer adjacent said optically-transmissive panel operative to modify light impinging thereon, said light modification layer comprising a reflective layer inwards of said optically-transmissive panel; and a transparent glossy layer between said light modification layer and said optically-transmissive panel.

2. The light assembly according to claim 1, wherein said optically-transmissive panel spans 360° about the central axis.

3. The light assembly according to claim 1, wherein said optically-transmissive panel continuously curves about the central axis.

4. The light assembly according to claim 1, wherein said optically-transmissive panel is conically shaped and said array of LEDs is ring-shaped.

5. The light assembly according to claim 1, wherein said optically-transmissive panel has at least one flat portion.

6. The light assembly according to claim 1, further comprising a solar energy collecting portion mounted on the light assembly, said solar energy collecting portion comprising at least one solar photovoltaic panel for collecting and converting incident solar energy to electricity to power said array of LEDs.

7. The light assembly according to claim 6, further comprising batteries that store electricity from said solar energy collecting portion, said batteries being electrically connected to said array of LEDs.

8. The light assembly according to claim 1, wherein said light modification layer and said transparent glossy layer are connected to said optically-transmissive panel at bayonet connection points, and said array of LEDs are mounted on a substrate mounted over said bayonet connection points.

9. The light assembly according to claim 1, wherein said transparent glossy layer comprises a laser-formed pattern of points on its inside surface.

* * * * *